US009144997B2

(12) United States Patent
Ng et al.

(10) Patent No.: US 9,144,997 B2
(45) Date of Patent: Sep. 29, 2015

(54) COLOR-DIRECTIONAL PRINTING

(75) Inventors: Peow Ng, Singapore (SG); Hwee Yee Ong, Singapore (SG); Tao Long, Singapore (SG)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/397,535

(22) PCT Filed: Jun. 15, 2012

(86) PCT No.: PCT/US2012/042604

§ 371 (c)(1),
(2), (4) Date: Oct. 28, 2014

(87) PCT Pub. No.: WO2013/187909

PCT Pub. Date: Dec. 19, 2013

(65) Prior Publication Data

US 2015/0124013 A1 May 7, 2015

(51) Int. Cl.

| | |
|---|---|
| ***B41J 2/205*** | (2006.01) |
| ***B41J 2/21*** | (2006.01) |
| ***B41J 19/14*** | (2006.01) |

(52) U.S. Cl.

CPC *B41J 2/2103* (2013.01); *B41J 2/21* (2013.01); *B41J 19/142* (2013.01)

(58) Field of Classification Search

CPC ..... B41J 11/009; B41J 2/21; B41J 2/2056; B41J 19/147; H04N 1/00175; H04N 1/233; H04N 1/46; H04N 1/60; H04N 1/6027

USPC ..... 347/9, 14, 15, 43; 358/1.1, 1.2, 1.9, 2.1

See application file for complete search history.

(56) References Cited

U.S. PATENT DOCUMENTS

| | | | | |
|---|---|---|---|---|
| 6,491,374 | B1 | 12/2002 | Bauer et al. | |
| 6,530,635 | B2 | 3/2003 | Otsuki | |
| 6,866,365 | B1 | 3/2005 | Neese et al. | |
| 8,899,708 | B2 * | 12/2014 | Ito et al. | 347/9 |
| 2004/0174403 | A1 | 9/2004 | Yoshida et al. | |
| 2004/0252160 | A1 | 12/2004 | Iwasaki | |

FOREIGN PATENT DOCUMENTS

| | | |
|---|---|---|
| CN | 1549590 | 10/2009 |
| JP | 2000318145 | 11/2000 |
| JP | 2001047645 | 2/2001 |
| JP | 2001232824 | 8/2001 |
| JP | 2001232824 A | 8/2001 |

OTHER PUBLICATIONS

International Search Report & Written Opinion received in PCT Application No. PCT/US2012/042604, Jan. 28, 2013, 8 pages.

* cited by examiner

*Primary Examiner* — An Do

(74) *Attorney, Agent, or Firm* — Hewlett-Packard Patent Department

(57) ABSTRACT

In an embodiment, a processor-readable medium stores code representing instructions that when executed by a processor cause the processor to separate image data into dark color data and light color data, and correlate the dark color data with a first printing direction and the light color data with a second printing direction, where the first and second printing directions are opposite one another. The instructions further cause the processor to print the dark color data in the first printing direction and the light color data in the second printing direction.

15 Claims, 4 Drawing Sheets

COLOR-DIRECTIONAL PRINTING

The present invention is a U.S. National Stage under 35 USC 371 patent application, claiming priority to Serial No. PCT/US12/42604, filed on 15 Jun. 2012, the entirety of which is incorporated herein by reference.

BACKGROUND

Differences in printmodes typically involve a tradeoff between image quality (IQ) and print speed. While printmodes that improve both image quality and speed are desirable, most printmode designs merely attempt to find the appropriate balance between image quality and print speed that is best suited to a particular printing application. For example, image quality is typically more important for photo printing applications, while printing speed may be more important for simple text printing applications. In a scanning-type inkjet printer where a printhead scans back and forth across the media on a carriage), a unidirectional printmode is often used when printing photos, since this printmode provides high image quality. However, the higher image quality of the unidirectional printmode comes at the expense of print speed, because lines of the image are printed in only one direction (usually from left to right across the media). In bidirectional printmodes, one line is typically printed from left to right, followed by a line being printed from right to left, and so on. Bidirectional printing is faster than printing in one direction only, because there is no need to wait for the printhead carriage or other imaging mechanism to return to the left margin before starting a new line.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Overview of Problem and Solution

Figure 1:
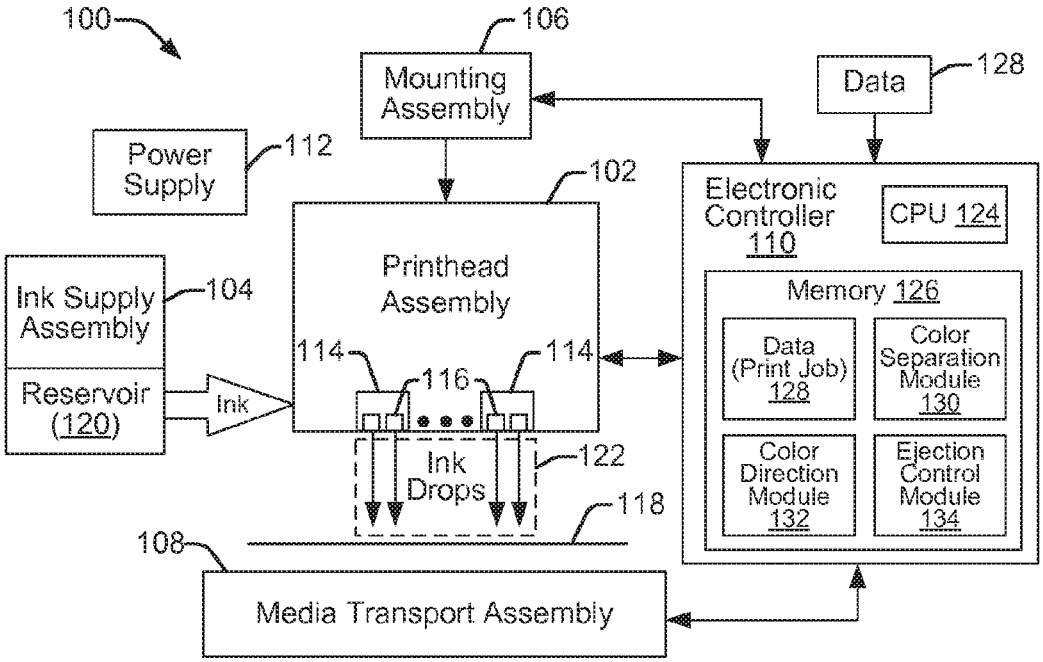
FIG. 1 shows an inkjet printing system suitable for implementing a color-directional printmode that selects certain colors to print in an opposite unidirectional manner as disclosed herein, according to an embodiment.

As noted above, the main considerations in any printmode design are speed and image quality (IQ). In unidirectional printing, a printhead typically ejects ink droplets as it scans in the forward pass direction across the media (i.e., from left to right). While unidirectional printing provides higher image quality, it typically comes at the expense of printing speed. Bidirectional printing increases printing speed but reduces the image quality. In bidirectional printing, the printhead ejects ink droplets in both the forward and reverse passes as it scans back and forth across the media. However, dot placement error (DPE) is often associated with bidirectional printing. Dot placement error can be due to mechanical movement error, and/or calibration error, for example.

Better image quality in unidirectional printing comes in part by the elimination of dot placement error (DPE) associated with bidirectional printing. However, one potential disadvantage with unidirectional printing is a print defect known as coalescence. Coalescence can occur when all the ink colors are printed in unidirection at high carriage/scanning speeds. A sudden flood of ink onto the media can result in heavily printed areas that have a blotchy, non-uniform appearance. If ink is deposited too quickly, or in amounts that the media cannot absorb, ink drops begin to combine into larger drops or ink puddles that cause visible non-uniformities when they dry.

Another disadvantage with unidirectional printing of all ink colors is the risk that the printhead will strike the media. Headstrikes usually happen when the media gets overly wet and starts to cockle or curl. Unidirectional printing of all ink colors can increase the chances of a headstrike if too much ink is deposited onto the media and the media is left in the printzone for too long a time period. Therefore, printmode designs involve a consideration of whether to print slowly to achieve high print quality while risking headstrikes, or to print quickly to minimize the risk of headstrikes but have reduced image quality.

Embodiments of the present disclosure help to overcome disadvantages such as those mentioned above, generally through a color-directional printmode that selects certain colors to print in a unidirectional manner. Darker inks, which are more susceptible to DPE, are printed together in the same printing pass. Lighter inks, which are less susceptible to DPE, are also printed together, but in a printing pass that is in the opposite direction as the darker inks. Thus, darker inks may be printed in the forward passes, while lighter inks are printed in the reverse passes, or vice versa. Thus, the color-directional printmode selectively prints those colors (i.e., darker colors) that need good dot placement for good image quality IQ, in unidirection (e.g., on forward passes), while printing the remaining lighter colors in the opposite, or bi-, direction (e.g., on reverse passes) to minimize coalescence. The disclosed embodiments describe a selective color-directional printmode that provides both improved print speed over traditional unidirectional printing modes, while at the same time providing improved image quality over traditional bidirectional printing modes.

In one example embodiment, a processor-readable medium stores code representing instructions that when executed by a processor cause the processor to separate image data into dark color data and light color data. The instructions further cause the processor to correlate the dark color data with a first printing direction and the light color data with a second printing direction. The first and second printing directions are opposite one another. The instructions then cause the processor to print the dark color data in the first printing direction and the light color data in the second printing direction.

In another example embodiment, a printer includes a printhead to form an image by ejecting ink onto media while scanning in first and second directions across the media. The printer also includes a color separation module to separate image data into dark color data and light color data, and a color direction module to select dark color data for printing in the first direction and light color data for printing in the second direction. The printer also includes an ejection control module to move the printhead in the first and second directions and eject ink from the printhead based on the selections made by the color direction module.

In another example embodiment, a processor-readable medium stores code representing instructions that when executed by a processor cause the processor to receive image content data. In some implementations, the processor converts the data into printer language (e.g., PCL, Postscript, etc.) and from RGB color format to a printable color format such as CMYK. The instructions further cause the processor to separate the image content data into dark color data associated with dark ink colors, and light color data associated with light ink colors. The instructions then cause the processor to print the dark ink colors from a printhead only as the printhead passes over a print medium in a forward direction, and to print the light ink colors from the printhead only as the printhead passes over the print medium in a reverse direction.

Illustrative Embodiments

FIG. 1 illustrates an inkjet printing system 100 suitable for implementing a color-directional printmode that selects certain colors to print in an opposite unidirectional manner as disclosed herein, according to an embodiment of the disclosure. In this embodiment, the fluid ejection assembly is disclosed as a fluid drop jetting printhead 114. Inkjet printing system 100 includes an inkjet printhead assembly 102, an ink supply assembly 104, a mounting assembly 106, a media transport assembly 108, an electronic printer controller 110, and at least one power supply 112 that provides power to the various electrical components of inkjet printing system 100. Inkjet printhead assembly 102 includes at least, one fluid ejection assembly 114 (printhead 114) having a printhead die that ejects drops of ink through a plurality of orifices or nozzles 116 toward a print medium 118 so as to print onto the print medium 118. Print medium 118 is any type of suitable sheet material, such as paper, card stock, transparencies, Mylar, and the like. Typically, nozzles 116 are arranged in one or more columns or arrays such that properly sequenced ejection of ink from nozzles 116 causes characters, symbols, and/or other graphics or images to be printed upon print medium 118 as inkjet printhead assembly 102 and print medium 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form a one-way ink delivery system or a recirculating ink delivery system. In a one-way ink delivery system, substantially all of the ink supplied to inkjet printhead assembly 102 is consumed during printing. In a recirculating ink delivery system, however, only a portion of the ink supplied to printhead assembly 102 is consumed during printing. Ink not consumed during printing is returned to ink supply assembly 104.

In one embodiment, inkjet printhead assembly 102 and ink supply assembly 104 are housed together in an inkjet cartridge or pen. In another embodiment, ink supply assembly 104 is separate from inkjet printhead assembly 102 and supplies ink to inkjet printhead assembly 102 through an interface connection, such as a supply tube. In either embodiment, reservoir 120 of ink supply assembly 104 may be removed, replaced, and/or refilled. In one embodiment, where inkjet printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Figure 2:
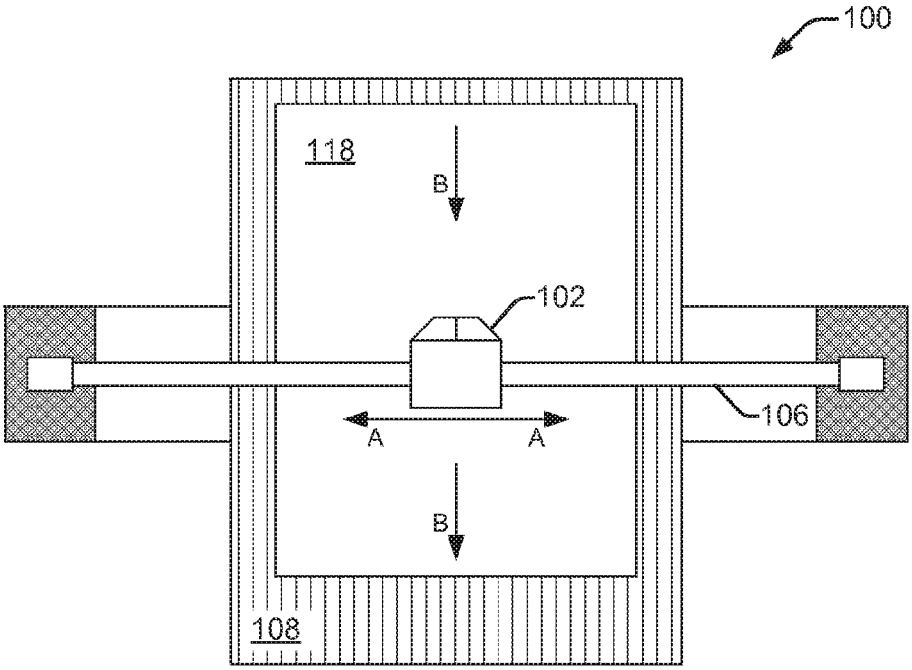
FIG. 2 shows an example of a scanning type inkjet printing system suitable for implementing a color-directional printmode that selects certain colors to print in an opposite unidirectional manner as disclosed herein, according to an embodiment.

Mounting assembly 106 positions inkjet printhead assembly 102 relative to media transport assembly 108, and media transport assembly 108 positions print medium 118 relative to inkjet printhead assembly 102. Thus, a print zone 122 is defined adjacent to nozzles 116 in an area between inkjet printhead assembly 102 and print medium 118. In one embodiment, inkjet printing system 100 is a scanning type printer where inkjet printhead assembly 102 is a scanning printhead assembly. FIG. 2 illustrates an example of a scanning type inkjet printing system 100, according to an embodiment of the disclosure. In a scanning type inkjet printing system 100, mounting assembly 106 includes a carriage for moving the inkjet printhead assembly 102 relative to media transport assembly 108 in a horizontal manner that scans printhead(s) 114 back and forth across the print medium 118 in forward and reverse passes, as indicated in FIG. 2 by the horizontal arrows labeled A. Thus, media transport assembly 108 positions print medium 118 relative to inkjet printhead assembly 102 by moving the print medium 118 along a path that is orthogonal to the horizontal movement of the printhead assembly 102, as indicated by the vertical arrows labeled B.

Electronic printer controller 110 typically includes a processor (CPU) 124, a memory 126, firmware, and other printer electronics for communicating with and controlling inkjet printhead assembly 102, mounting assembly 106, and media transport assembly 108. Memory 126 can include both volatile (i.e., RAM) and nonvolatile (e.g., ROM, hard disk, floppy disk, CD-ROM, etc.) memory components comprising computer/processor-readable media that provide for the storage of computer/processor-readable coded instructions, data structures, program modules, and other data for printing system 100. Electronic controller 110 receives data 128 from a host system, such as a computer, and stores the data 128 in memory 126. Typically, data 128 is sent to inkjet printing system 100 along an electronic, infrared, optical, or other information transfer path. Data 128 represents, for example, a document or image file to be printed. As such, data 128 forms a print job for inkjet printing system 100 that includes one or more print job commands and/or command parameters. Using data 128, electronic controller 110 controls inkjet printhead assembly 102 to eject ink drops from nozzles 116. Thus, electronic controller 110 defines a pattern of ejected ink drops that form characters, symbols, and/or other graphics or images on print medium 118. The pattern of ejected ink drops is determined by the print job commands and/or command parameters from data 128.

In one embodiment, electronic controller 110 includes software instruction modules stored in memory 126 and executable on processor 124 to manage and manipulate data 128 in order to control how and when different colors of ink are ejected from printhead(s) 114 as the printhead assembly 102 moves back and forth in forward and reverse passes across the print medium 118. The software instruction modules include a color separation module 130, a color direction module 132, and an ejection control module 134. The color separation module 130 executes to differentiate image data into dark color data and light color data. The color direction module 132 executes to select dark color data for printing in a first direction and light color data for printing in a second, and opposite direction. The ejection control module 136 executes to move the inkjet printhead assembly 102 with printhead(s) 114 in the first and second directions and to eject ink from the printhead(s) 114 based on the color direction selections made by the color direction module 132.

Figure 3:
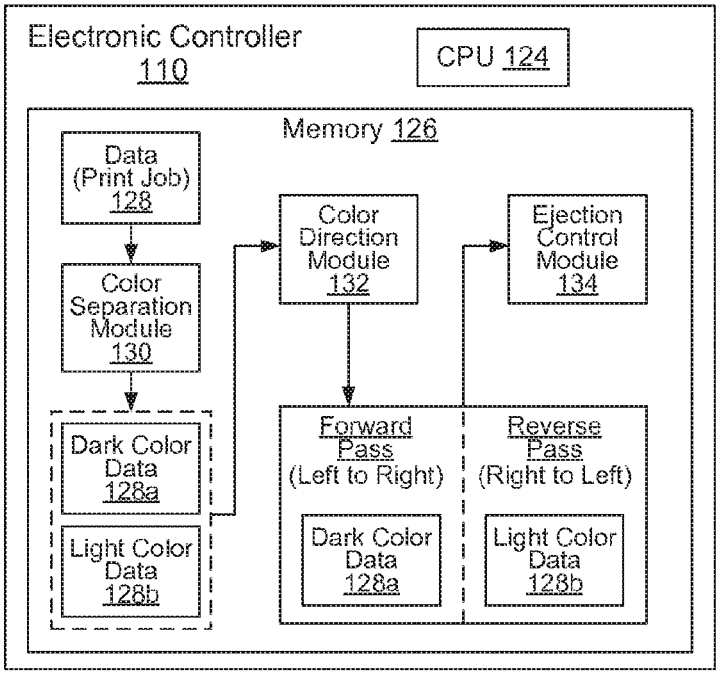
FIG. 3 shows an example block diagram of the electronic controller illustrating functional aspects of the color separation module, the color direction module, and the ejection control module, according to an embodiment.

FIG. 3 shows an example block diagram of the electronic controller 110 illustrating functional aspects of the color separation module 130, the color direction module 132, and the ejection control module 136, according to an embodiment of the disclosure. It is noted that the terms "document" and "image" may be used interchangeably throughout this description to refer to any document and/or image that, in different formats, can be displayed on a display device (e.g., on a computer monitor, screen, etc.) and printed on a printer. Data 128 represents document/image content data or a print job that has undergone one or more conversions from a previous RGB (red, green, blue) color data format displayable on a computer monitor, to a printable color data format. Thus, data 128 is assumed to be in an appropriate printer language format such as PCL or Postscript, and an appropriate printable color data format, such as CMYK (cyan, yellow, magenta, black). Such conversions may take place, for example, on a host computer or on printing system 100 through the implementation of an appropriate printer driver (not shown).

In addition, while embodiments herein are described with respect to the CMYK color format, other printable color data formats are contemplated. For example, other embodiments can include the use of printing systems implementing six or eight color printing processes. Such printing systems may implement a six color CMYKLcLm format that uses CMYK inks plus a lighter shade of cyan (Lc) and magenta (Lm), or an eight color CMYKLcLmLyLk format that uses CMYK, Lc, Lm, and a diluted yellow (Ly) and black (Lk). In general, six and eight color processes are able to create more realistic photo images with less graininess and smoother gradients. Thus, descriptions herein related to CMYK color format are not intended as a limitation to a printable color format, but rather, are readily applicable to other printable color formats such as six and eight color formats.

Referring again to FIG. 3, color separation module 130 executes to analyze data 128 and separate it into different color components on the basis of dark color data and light color data. Therefore, color separation module 130 separates data 128 into dark color data 128*a* and light color data 128*b*, as shown in FIG. 3. Assuming data 128 is in CMYK color format, the dark color data 128*a* can include data for the KCM ink colors while the light color data 128*b* can include data for the Y ink colors. The color separation process will vary given other color data formats such as a six color CMYKLcLm format or eight color CMYKLcLmLyLk format as noted above.

Once the data 128 is separated into dark color data 128*a* and light color data 128*b*, the color direction module 132 determines or selects the direction in which the different colors are to be ejected from printhead(s) 114 as the inkjet printhead assembly 102 traverses mounting assembly 106 across the print medium 118. For example, the color direction module 132 may determine that ink for the dark color data 128*a* will be ejected during the forward passes of the inkjet printhead assembly 102 as it travels from left to right across the print medium 118, while ink for the light color data 128*b* will be ejected during the reverse (or retrace) passes of the inkjet printhead assembly 102 as it travels from right to left across the print medium 118. Thus, the color direction module 132 ensures that the light and dark ink colors are printed in opposite directions across the print medium 118. As shown in FIG. 3, the color direction module 132 achieves an opposite print direction for dark and light ink colors by selecting or correlating the dark color data 128*a* for forward printing passes and the light color data 128*b* for reverse printing passes. However, in other embodiments, an opposite print direction for dark and light colors is achieved by selecting or correlating the light color data 128*b* for forward printing passes and the dark color data 128*a* for reverse printing passes.

After the color direction module 132 correlates the dark and light ink color data with appropriate printing directions, the ejection control module 134 executes to specifically coordinate the ejection of different colored inks with the forward and reverse passes of the inkjet printhead assembly 102 as it travels from right to left across the print medium 118.

Figure 4:
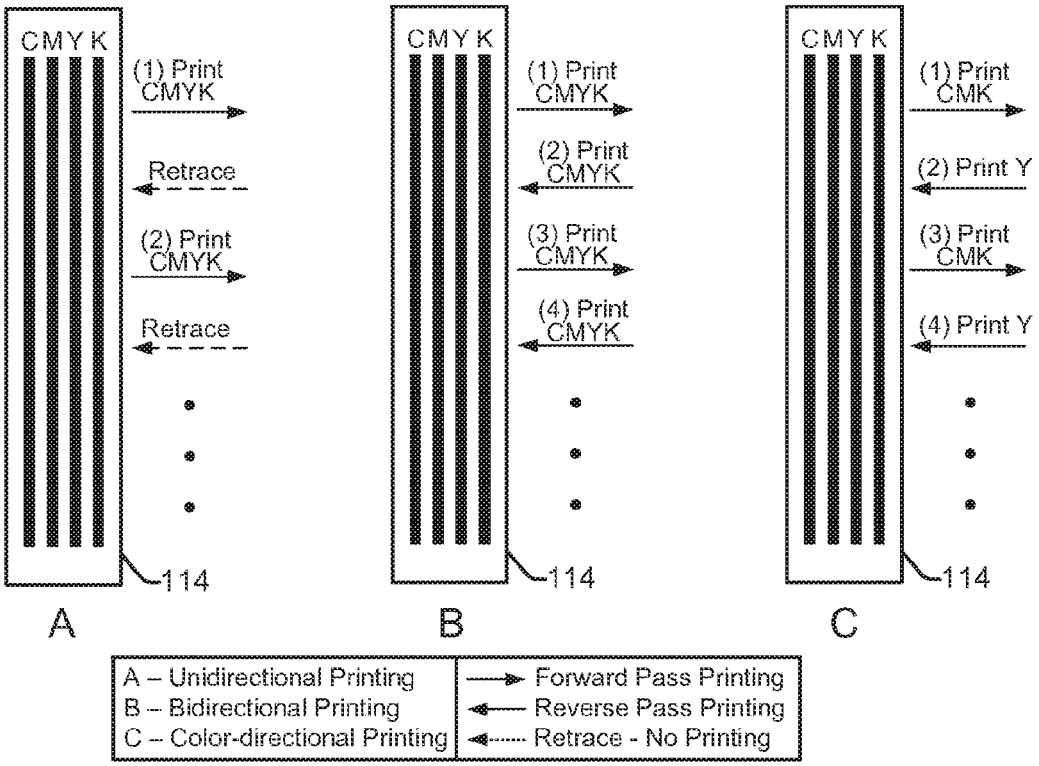
FIG. 4 shows an example of color-directional printing from a printhead, according to an embodiment.

FIG. 4 shows an example of color-directional printing from a printhead 114, according to an embodiment of the disclosure. For the sake of comparison, a traditional unidirectional print process "A", and bidirectional print process "B", are shown along with the color-direction print process "C". When printing in CMYK color format in a traditional unidirectional print process, "A", all color inks in the CMYK color space are printed as the inkjet printhead moves in the forward pass direction, from left to right across a print medium. On the reverse pass direction, or the retrace, there is no printing from the printhead. Printing then resumes on the next forward pass. In traditional bidirectional printing "B", all color inks in the CMYK color space are also printed as the inkjet printhead moves in the forward pass direction, from left to right across a print medium. However, on the reverse pass, the printhead continues printing all of the CMYK ink colors.

By way of contrast with both of the traditional unidirectional and bidirectional printmodes, in the color-directional printmode "C", all of the CMYK colors are not printed in either the forward or reverse pass directions. Instead, the CMYK colors are separated and then printed in different directions according to their colors. In color-directional printing, the dark ink colors are printed in a first direction, and the light ink colors are printed in a second, opposite, direction. As shown in FIG. 4, for example, the dark color inks (KCM) of the CMYK color format are printed in the forward pass direction, and the light color inks (Y) of the CMYK color format are printed in the reverse pass direction, opposite the printing direction of the dark colors. In general, while the dark color data 128*a* is shown in FIG. 4 as being printed first, in the forward pass direction (i.e., left to right), and light color data 128*b* is shown being printed second, in the reverse pass direction (i.e., right to left), in other embodiments the printing directions for the dark and light color data can be reversed. That is, the light color data may be printed first in the forward pass direction, with the dark color data being printed second, in the reverse pass direction.

Figure 5:
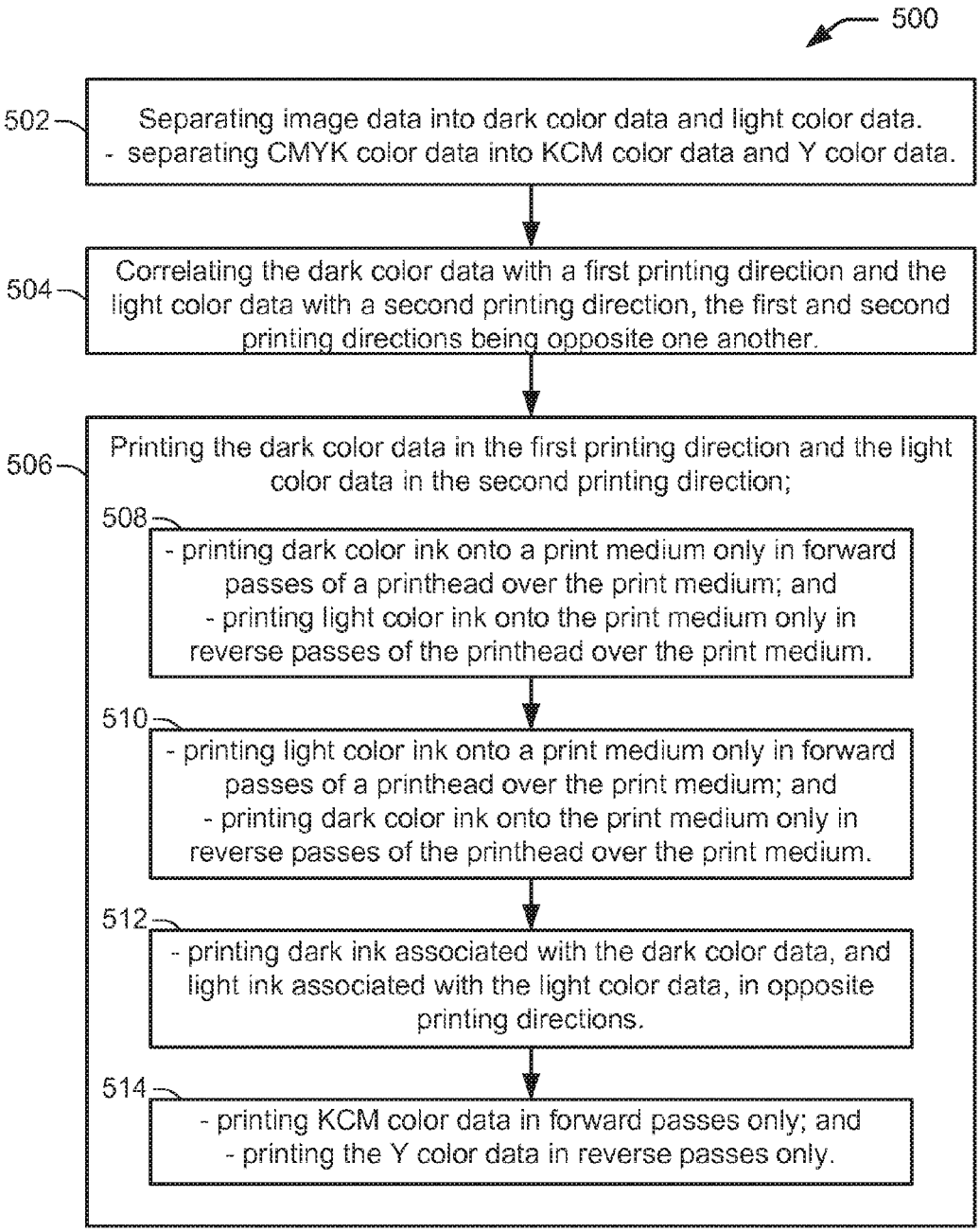
FIG. 5 shows a flowchart of an example method related to color-directional printing, according to an embodiment.
Figure 6:
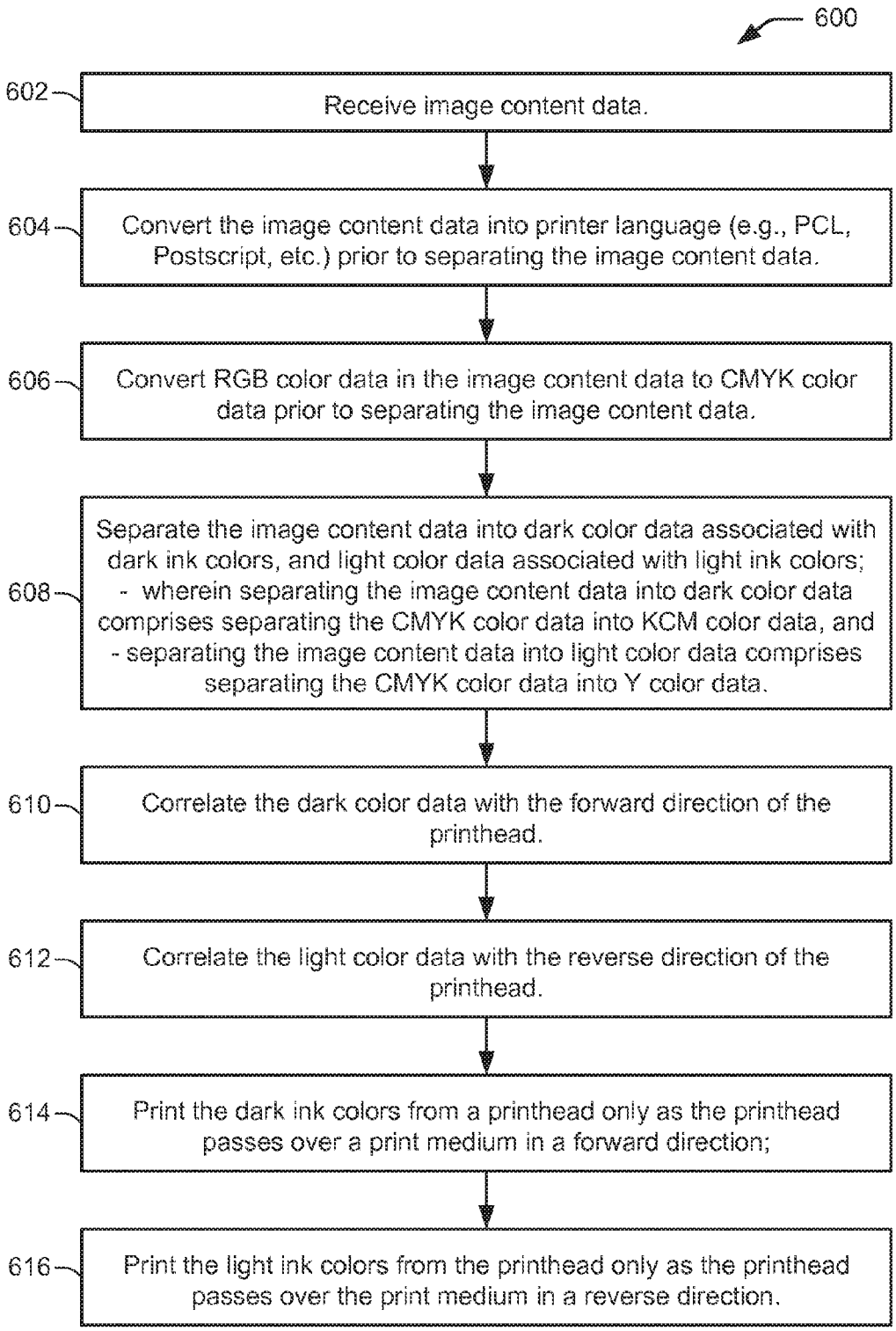
FIG. 6 shows a flowchart of an example method related to color-directional printing, according to an embodiment.

FIGS. 5 and 6, show flowcharts of example methods 500 and 600, related to color-directional printing, according to embodiments of the disclosure. Methods 500 and 600 are associated with the embodiments discussed above with regard to FIGS. 1-4, and details of the steps shown in methods 500 and 600, can be found in the related discussion of such embodiments. The steps of methods 500 and 600, may be embodied as programming instructions stored on a computer/processor-readable medium, such as memory 126 of FIGS. 1 and 3. In an embodiment, the implementation of the steps of methods 500 and 600, is achieved by the reading and execution of such programming instructions by a processor, such as processor 124 of FIGS. 1 and 3. Methods 500 and 600, may include more than one implementation, and different implementations of methods 500 and 600, may not employ every step presented in the respective flowcharts. Therefore, while steps of methods 500 and 600, are presented in a particular order within their respective flowcharts, the order of their presentation is not intended to be a limitation as to the order in which the steps may actually be implemented, or as to whether all of the steps may be implemented. For example, one implementation of method 500 might be achieved through the performance of a number of initial steps, without performing one or more subsequent steps, while another implementation of method 500 might be achieved through the performance of all of the steps.

Method 500 of FIG. 5, begins at block 502, where the first step shown is separating image data into dark color data and light color data. In some implementations, separating image data into dark color data and light color data comprises separating CMYK color data into KCM color data and Y color data. In other implementations, other color processes such as six and eight color processes may be employed such that separating image data into dark color data and light color data may comprise separating six color CMYKLcLm format data or eight color CMYKLcLmLyLk format data into dark and light colors. At block 504, the method 500 continues with correlating the dark color data with a first printing direction and the light color data with a second printing direction. The first and second printing directions are opposite one another.

At block 506, method 500 continues with printing the dark color data in the first printing direction and the light color data in the second printing direction. In some implementations, as shown at block 508, this can include printing dark color ink onto a print medium only in forward passes of a printhead over the print medium, and printing light color ink onto the print medium only in reverse passes of the printhead over the print medium. In other implementations, as shown at block 510, this can include printing light color ink onto a print medium only in forward passes of the printhead over the print medium, and printing dark color ink onto the print medium only in reverse passes of the printhead over the print medium.

As shown at block 512 of method 500, printing the dark color data in the first printing direction and the light color data in the second printing direction comprises printing dark ink associated with the dark color data, and light ink associated with the light color data, in opposite printing directions. Also, as shown at block 514 printing the dark color data in the first printing direction and the light color data in the second printing direction can include printing KCM color data in forward passes only, and printing the Y color data in reverse passes only.

Method 600 of FIG. 6, begins at block 602, where the first step shown is to receive image content data. As shown at blocks 604 and 606, in some implementations, prior to separating the image content data, the image content data is converted into printer language (e.g., PCL, Postscript, etc.), and RGB color data in the image content data is converted into CMYK color data. In some implementations, however, these conversion steps may already have occurred. At block 608, the method 600 continues with separating the image content data into dark color data associated with dark ink colors, and light color data associated with light ink colors. In some implementations, separating the image content data into dark color data comprises separating the CMYK color data into KCM color data, and separating the image content data into light color data comprises separating the CMYK color data into Y color data.

As shown at blocks 610 and 612, the method 600 further includes correlating the dark color data with the forward direction of the printhead, and correlating the light color data with the reverse direction of the printhead. At blocks 614 and 616, the method 600 then includes printing the dark ink colors from a printhead only as the printhead passes over a print medium in a forward direction, and printing the light ink colors from the printhead only as the printhead passes over the print medium in a reverse direction.

What is claimed is:

1. A processor-readable medium storing code representing instructions that when executed by a processor cause the processor to:

separate image data into dark color data and light color data;

correlate the dark color data with a first printing direction and the light color data with a second printing direction, the first and second printing directions being opposite one another; and print the dark color data in the first printing direction and the light color data in the second printing direction.

2. A processor-readable medium as in claim 1, wherein printing the dark color data in the first printing direction and the light color data in the second printing direction comprises:

printing dark color ink onto a print medium only in forward passes of a printhead over the print medium; and printing light color ink onto the print medium only in reverse passes of the printhead over the print medium.

3. A processor-readable medium as in claim 1, wherein printing the dark color data in the first printing direction and the light color data in the second printing direction comprises:

printing light color ink onto a print medium only in forward passes of a printhead over the print medium; and printing dark color ink onto the print medium only in reverse passes of the printhead over the print medium.

4. A processor-readable medium as in claim 1, wherein printing the dark color data in the first printing direction and the light color data in the second printing direction comprises printing dark ink associated with the dark color data, and light ink associated with the light color data, in opposite printing directions.

5. A processor-readable medium as in claim 1, wherein separating image data into dark color data and light color data comprises separating CMYK color data into KCM color data and Y color data, respectively.

6. A processor-readable medium as in claim 5, wherein printing the dark color data in the first printing direction and the light color data in the second printing direction comprises:

printing the KCM color data in forward passes only; and printing the Y color data in reverse passes only.

7. A processor-readable medium as in claim 1, wherein the instructions further cause the processor to:

correlate the dark color data with the forward direction of the printhead; and correlate the light color data with the reverse direction of the printhead.

8. A processor-readable medium as in claim 1, wherein the instructions further cause the processor to:

convert the image content data into printer language prior to separating the image content data; and convert RGB color data in the image content data to CMYK color data prior to separating the image content data.

9. A processor-readable medium as in claim 8, wherein separating the image content data into dark color data comprises separating the CMYK color data into KCM color data, and separating the image content data into light color data comprises separating the CMYK color data into Y color data.

10. A printer comprising:

a printhead to form an image by ejecting ink onto media while scanning in first and second directions across the media;

a color separation module to separate image data into dark color data and light color data;

a color direction module to select dark color data for printing in the first direction and light color data for printing in the second direction; and an ejection control module to move the printhead in the first and second directions and eject ink from the printhead based on the selections of the color direction module.

11. A printer as in claim 10, wherein the image data comprises printer language image data in a color format selected from the group of formats consisting of a four color format, a six color format, and an eight color format.

12. A printer as in claim 10, wherein the image data comprises printer language image data in a four color CMYK format, and the color direction module is to select KCM color data for printing in the first direction and Y color data for printing in the second direction.

13. A printer as in claim 10, wherein the image data comprises printer language image data in a six color CMYKLcLm format, and the color direction module is to select KCM color data for printing in the first direction and Y, Lc, and Lm color data for printing in the second direction.

14. A printer as in claim 10, wherein the image data comprises printer language image data in an eight color CMYKLcLmLyLk format, and the color direction module is to select KCM color data for printing in the first direction and Y, Lc, Lm, Ly, and Lk color data for printing in the second direction.

15. A processor-readable medium storing code representing instructions that when executed by a processor cause the processor to:

receive image content data;

separate the image content data into dark color data associated with dark ink colors, and light color data associated with light ink colors;

print the dark ink colors from a printhead only as the printhead passes over a print medium in a forward direction; and print the light ink colors from the printhead only as the printhead passes over the print medium in a reverse direction.

* * * * *